US006131713A

United States Patent [19]

Sher

[11] Patent Number: 6,131,713

[45] Date of Patent: Oct. 17, 2000

[54] FRAMEWORK OF LUGGAGE

[76] Inventor: Yu-Yi Sher, 6, Alley 3, Lane 91, Section 1 Yan Der Tah Tau, Su Lin District, Taipei City, Taiwan

[21] Appl. No.: 09/362,160

[22] Filed: Jul. 28, 1999

[51] Int. Cl.[7] ..... A45C 5/13; A45C 13/02; A45C 13/36

[52] U.S. Cl. ..... 190/122; 190/18 A; 190/115; 190/127

[58] Field of Search ..... 190/18 A, 24, 190/39, 115, 122, 127

[56] References Cited

U.S. PATENT DOCUMENTS

| | | | |
|---|---|---|---|
| 2,710,084 | 6/1955 | Braverman | 190/127 X |
| 3,330,389 | 7/1967 | Kaplan | 190/115 |
| 4,004,664 | 1/1977 | Pelavin et al. | 190/127 |
| 4,813,520 | 3/1989 | Lin | 190/18 A X |
| 5,393,079 | 2/1995 | Wang | 190/18 A X |
| 5,474,162 | 12/1995 | Shyr et al. | 190/127 X |
| 5,547,052 | 8/1996 | Latshaw | 190/115 X |
| 5,566,798 | 10/1996 | Tsai | 190/115 |
| 5,588,512 | 12/1996 | Lin | 190/115 |
| 5,749,446 | 5/1998 | Hsieh | 190/115 X |
| 5,782,325 | 7/1998 | O'Shea et al. | 190/115 X |
| 5,875,876 | 3/1999 | Wang | 190/115 X |
| 6,021,874 | 2/2000 | Nykoluk | 190/18 A X |

FOREIGN PATENT DOCUMENTS

| | | | |
|---|---|---|---|
| 384449 | 8/1990 | European Pat. Off. | 190/127 |
| 2542989 | 9/1984 | France | 190/122 |
| 842531 | 6/1952 | Germany | 190/122 |
| 934545 | 10/1955 | Germany | 190/122 |
| 1958686 | 6/1971 | Germany | 190/122 |
| 8401093 | 3/1984 | WIPO | 190/127 |

*Primary Examiner*—Sue A. Weaver
*Attorney, Agent, or Firm*—Harrison & Egbert

[57] ABSTRACT

A luggage framework includes a top plate, a bottom plate, two wheel mounts, a plurality of corner connection seats, a plurality of cross rods, a plurality of corner cross rods, and a plurality of longitudinal support rods. The top plate is provided at four corners thereof with one corner connection seat, whereas the bottom plate is provided at both ends of the front side thereof with one corner connection seat. Both ends of the rear side of the bottom plate are fastened with the wheel mounts. The longitudinal support rods are located between the top plate and the bottom plate such that both ends of the longitudinal support rods are retained by the corner connection seats of the top plate, the two corner connection seats of the front side of the bottom plate, and the two the wheel mounts of the rear side of the bottom plate.

2 Claims, 9 Drawing Sheets

FRAMEWORK OF LUGGAGE

FIELD OF THE INVENTION

The present invention relates generally to a luggage, and more particularly to a framework of the luggage.

BACKGROUND OF THE INVENTION

As shown in FIG. 1, a luggage of the prior art has a framework 10 which comprises an inner frame 11 of an iron material. The inner frame 11 is provided at the top thereof with a top plate 12 made of a plastic material, and at the bottom thereof with a bottom plate 13 made of the plastic material. The framework 10 further comprises a pull-rod support frame 14 which is mounted in the rear side of the framework 10.

Such a prior art luggage framework 10 as described above is defective in design in that the iron inner frame 11 gives an added weight to the luggage, and that the iron inner frame 11 is prone to deform under pressure, and further that the framework 10 is not structurally stable.

SUMMARY OF THE INVENTION

The primary objective of the present invention is to provide a luggage framework which is free from the drawbacks of the prior art luggage framework described above.

In keeping with the principle of the present invention, the foregoing objective of the present invention is attained by a luggage framework comprising a pull-rod support frame, a top plate, a bottom plate, two wheel mounts, a plurality of corner connection seats, a plurality of long cross rods fastened at both ends thereof with the corner connection seats, a plurality of short cross rods fastened at both ends thereof with the corner connection seats, and a plurality of longitudinal support rods. The framework is light in weight and is structurally strong.

The foregoing objective, features, functions, and advantages of the present invention will be more readily understood upon a thoughtful deliberation of the following detailed description of the present invention with reference to the accompanying drawings.

BRIEF DESCROPTION OF THE DRAWINGS

FIG. 5-1 shows a front sectional view of the luggage framework of another embodiment of the present invention.

DETAILED DESCRIPTION OF THE INVENTION

Figure 1:
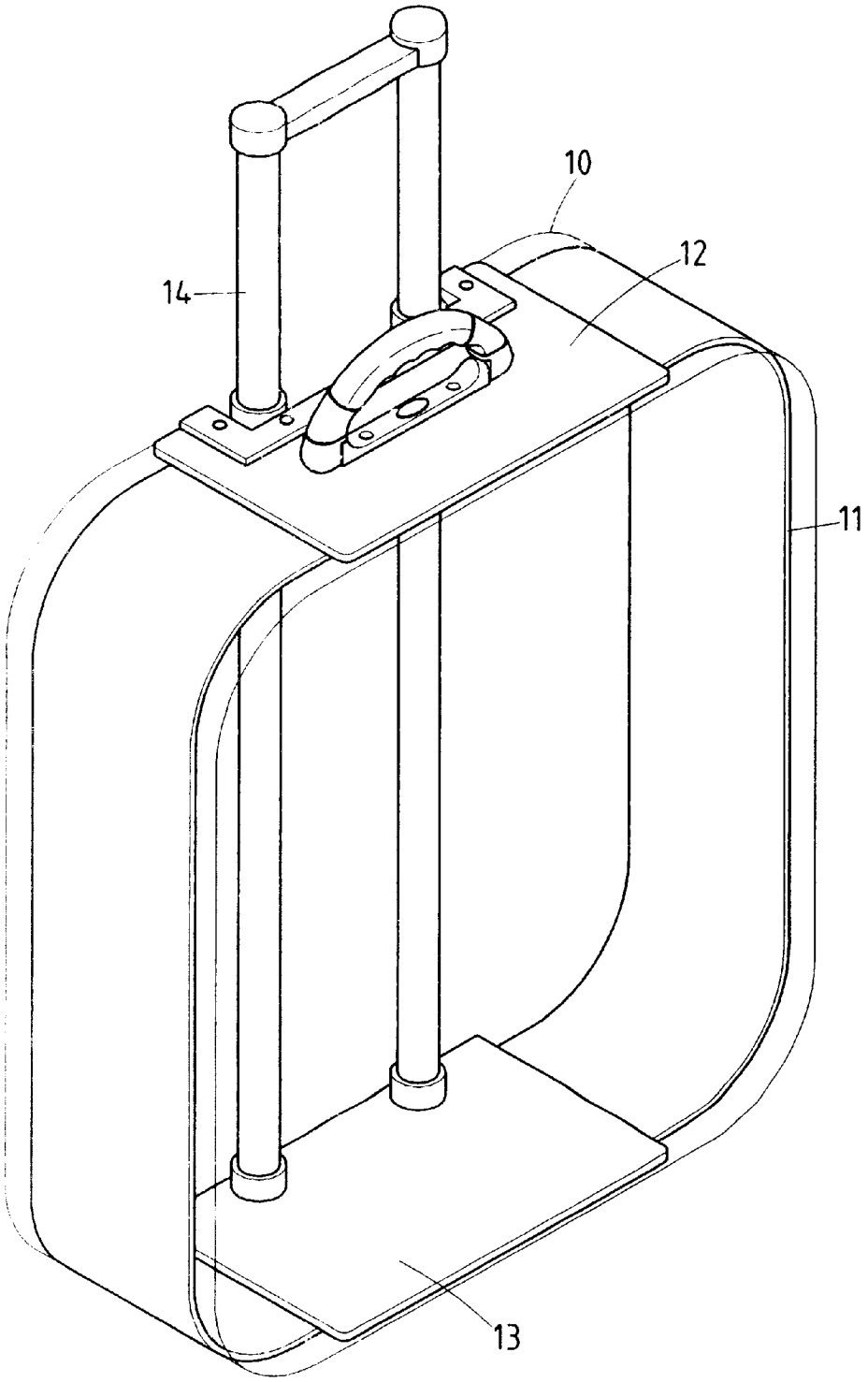
FIG. 1 PRIOR ART
FIG. 1 shows a perspective view of a luggage framework of the prior art.

As shown in FIGS. 2–5, a luggage framework 20 embodied in the present invention comprises a pull-rod support frame 30, a top plate 40, a bottom plate 50, two wheel mounts 60, six corner connection seats 70, long cross rods 80*a* and 80*b* fastened at both ends thereof with the corner connection seats 70, four corner cross rods 90 fastened at both ends thereof with the corner connection seats 70, and four longitudinal support rods 100.

The pull-rod support frame 30 is uprightly fastened with the back side of the framework 20 and is provided at the top thereof with a grip 31.

The top plate 40 is provided in the front side thereof with a front recess 41, and in the back side thereof with a back recess 42. The top plate 40 is further provided at both ends of the front side thereof with a through hole 43, and at both ends of the back side thereof with a through hole 44. An upper locating plate 32 of the pull-rod support frame 30 is fastened with the back recess 42 of the top plate 40 by two rivets 45 in conjunction with the through holes 44.

The bottom plate 50 is disposed at the bottom of the framework 20 and is fastened with the bottom ends of the pull-rod support frame 30. The bottom plate 50 is provided in the underside thereof with two leg seats 52 which are fastened with the bottom plate 50 by a plurality of rivets 51.

The two wheel mounts 60 are formed of a corner wheel 61 and a wheel cover 62 and are fastened with both ends of the back side of the bottom plate 50. The corner wheel 61 and the wheel cover 62 are fastened together by a plurality of rivets 63.

Each of the corner connection seats 70 is made integrally and is composed of a first arm 701 and a second arm 702 which forms a head 703 along with the first arm 701. Both the first arm 701 and the second arm 702 are provided at the free end thereof with an insertion hole 704. The head 703 is also provided with an insertion hole 704.

The long cross rods 80*a* is fastened at both ends thereof with two corner connection seats 70 which are disposed at both ends of the front side of the bottom plate 50. Both longitudinal ends of the long cross rod 80*a* are inserted into the insertion holes 704 of both arms 702 of the corner connection seat 70. The long cross rod 80*a* is fastened to the top plate 40 by rivets 801. The long cross rod 80*b* is fastened with the bottom plate 50 by a plurality of rivets 802. The corner connection seats 70 are fastened with the bottom plate 50 by a plurality of rivets 802. Two short cross rods 80*c* are fastened with the rear side of the top plate 40 by rivets 803 such that other end of the short cross rods 80*c* is inserted into the insertion hole 704 of the corner connection seats 70. These cross rods 80*c* are attached to the respective corner connection seats by rivets 83.

Two of the four corner cross rods 90 are fastened at both ends thereof with the insertion holes 705 of the heads 703 of the corner connection seats 70 which are fastened with the top plate 40, with the remaining two corner cross rods 90 being fastened at one end thereof with the insertion holes 705 of the corner connection seats 70 which are fastened with the bottom plate 50, such that other end of the remaining two corner cross rods 90 is inserted into the wheel cover 62.

Figure 5:
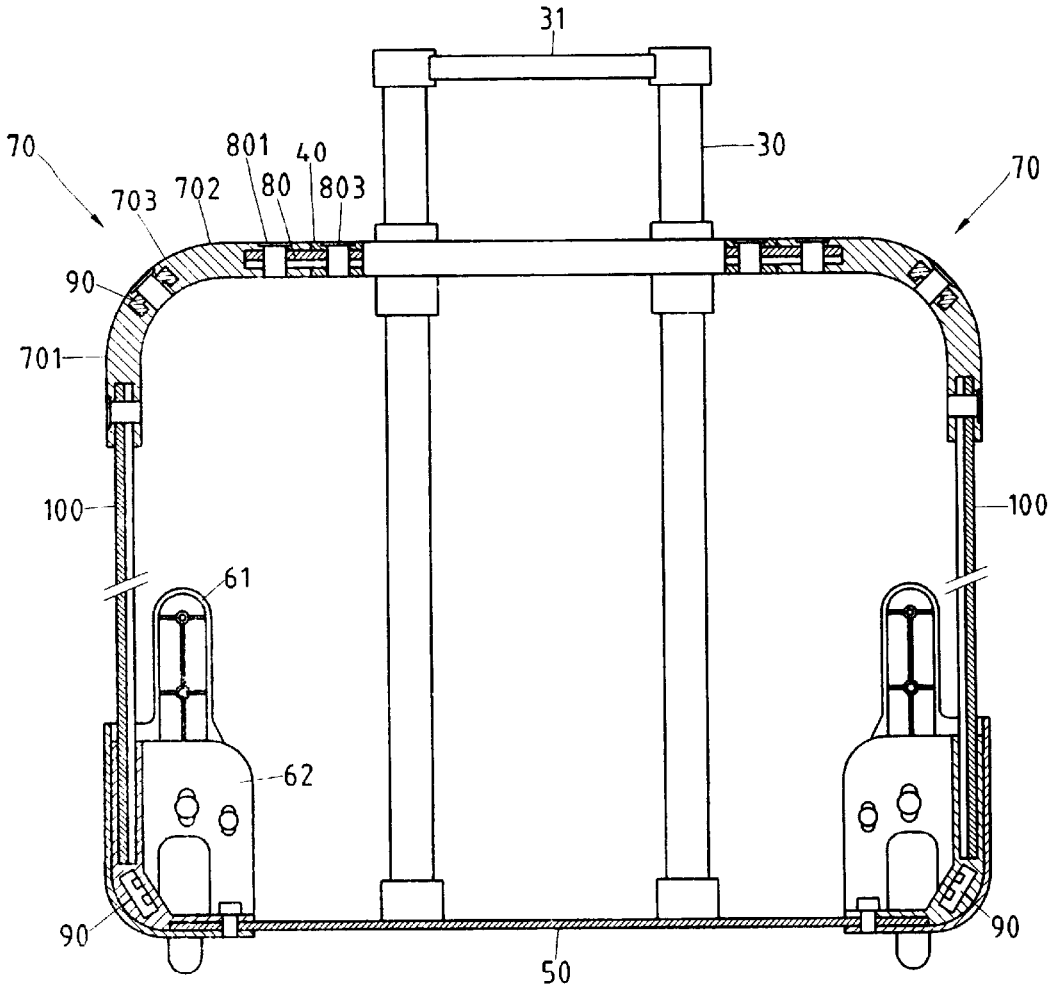
FIG. 5 shows a front sectional view of the luggage framework of the present invention.
Figures 1, 5:
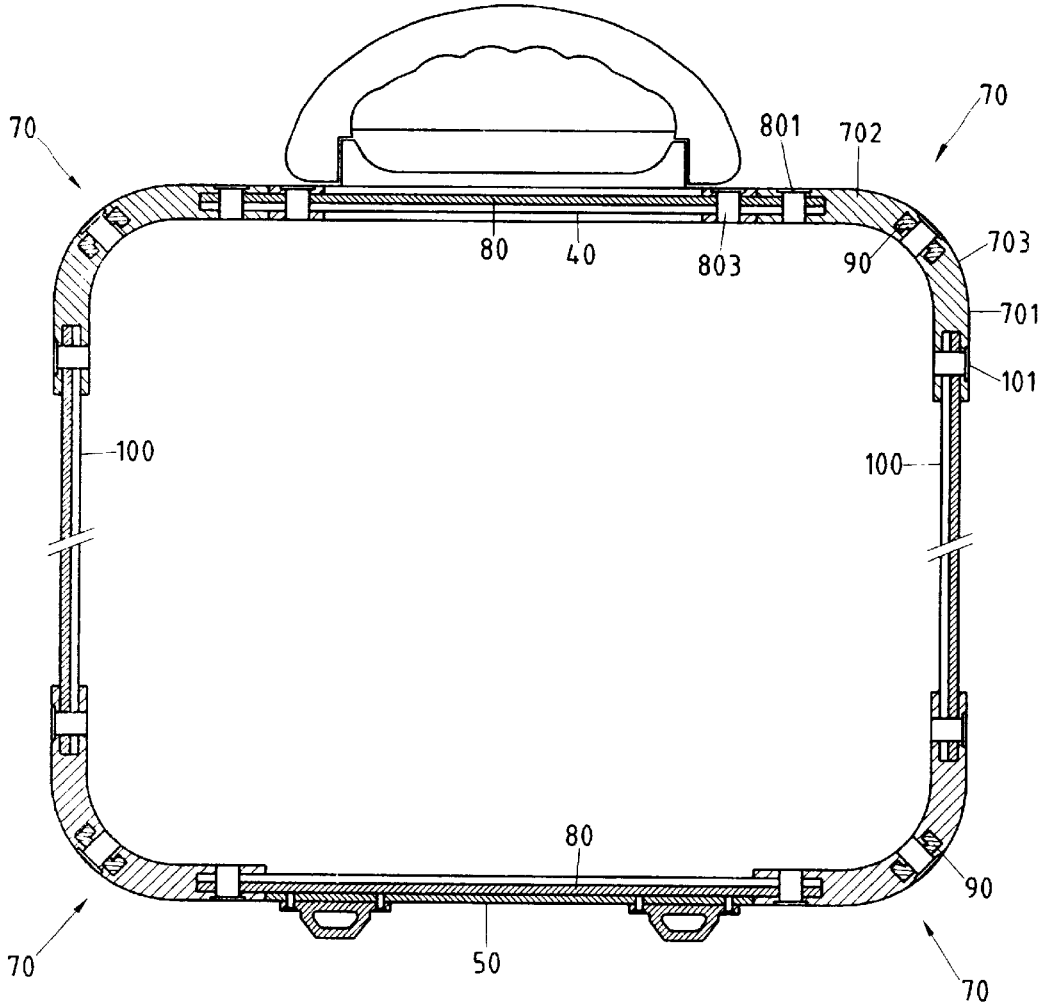
Figure 6:
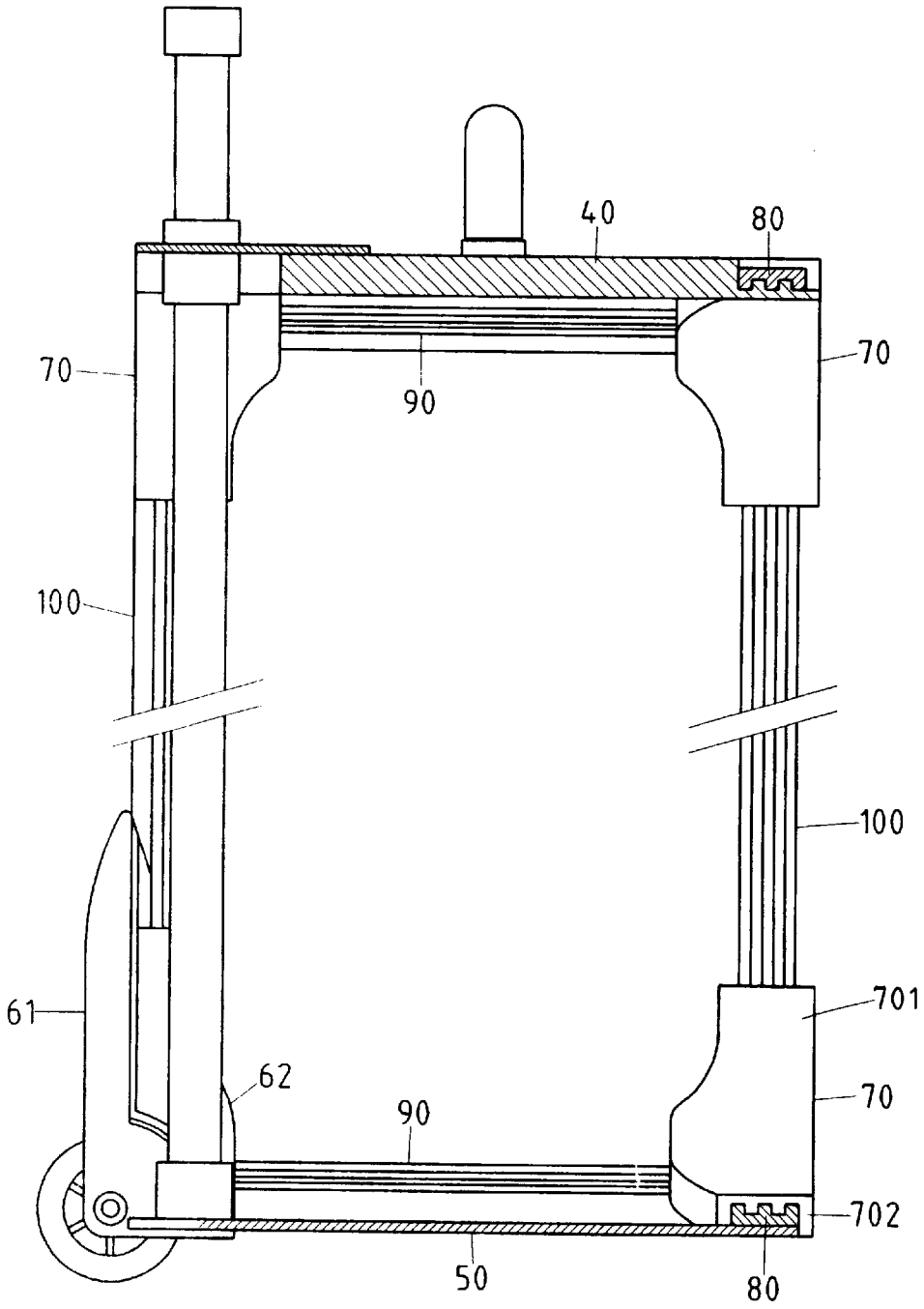
FIG. 6 shows a side sectional view of the luggage framework of the present invention.

As shown in FIGS. 5, 5-1, and 6, two of the four longitudinal support rods 100 are fastened at one end thereof with the arm 701 of the corner connection seat 70 by a rivet 101, whereas other two of the four longitudinal support rods 100 are fastened at the top end thereof with the arm 701 of the corner connection seat 70 by a rivet 102, and at the bottom end thereof with the wheel cover 62 by a rivet 103.

The insertion holes 704 and 705 of the corner connection seats 70 are provided therein with a corrugated surface 706.

The cross rods 80, the corner cross rods 90, and the longitudinal support rods 100 are provided with a corrugated surface 805 (905, 105) engageable with the corrugated surface 706 of the insertion holes 704 and 705.

Figure 2:
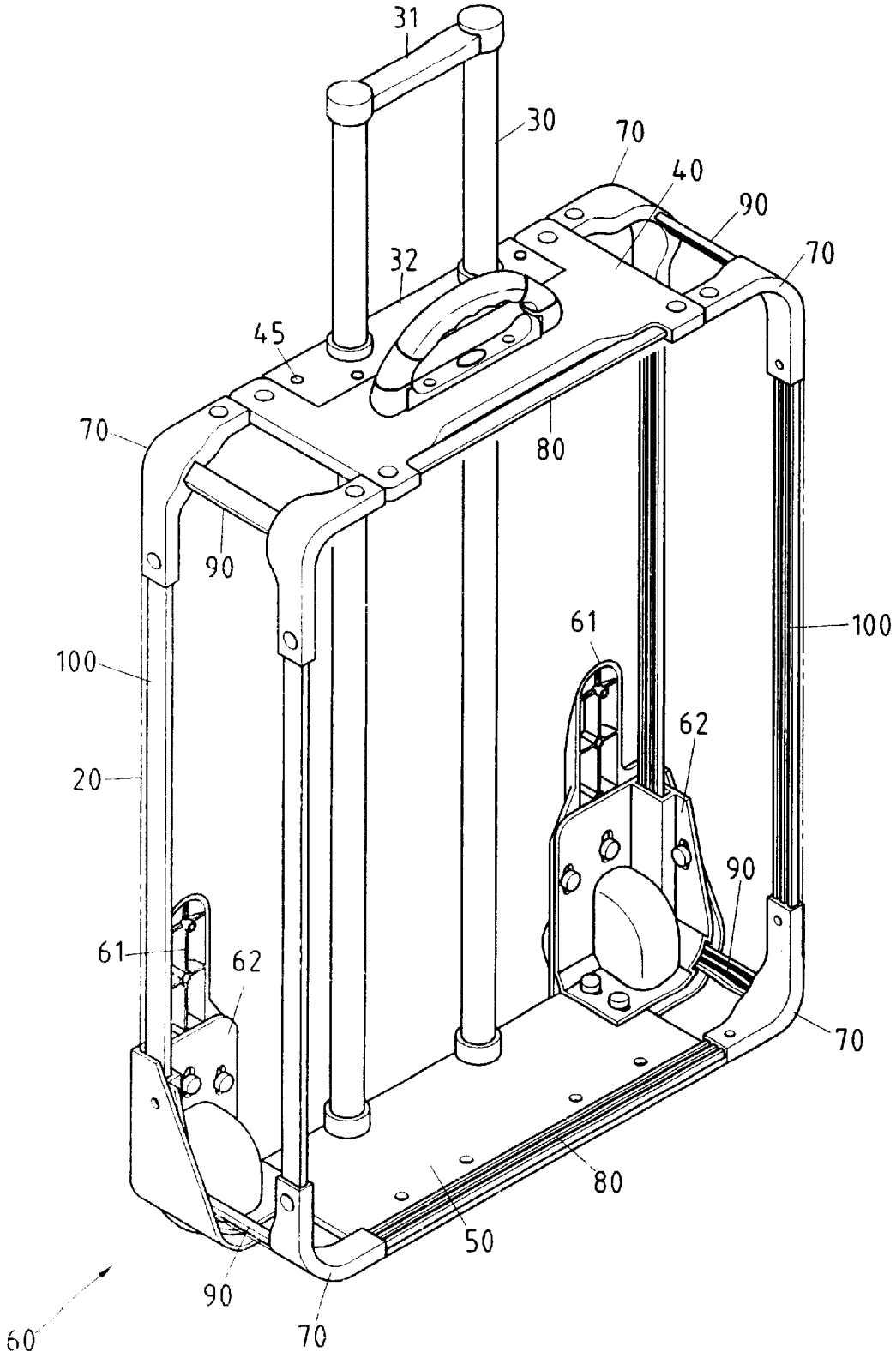
FIG. 2 shows a perspective view of a luggage framework of the present invention.
Figure 3:
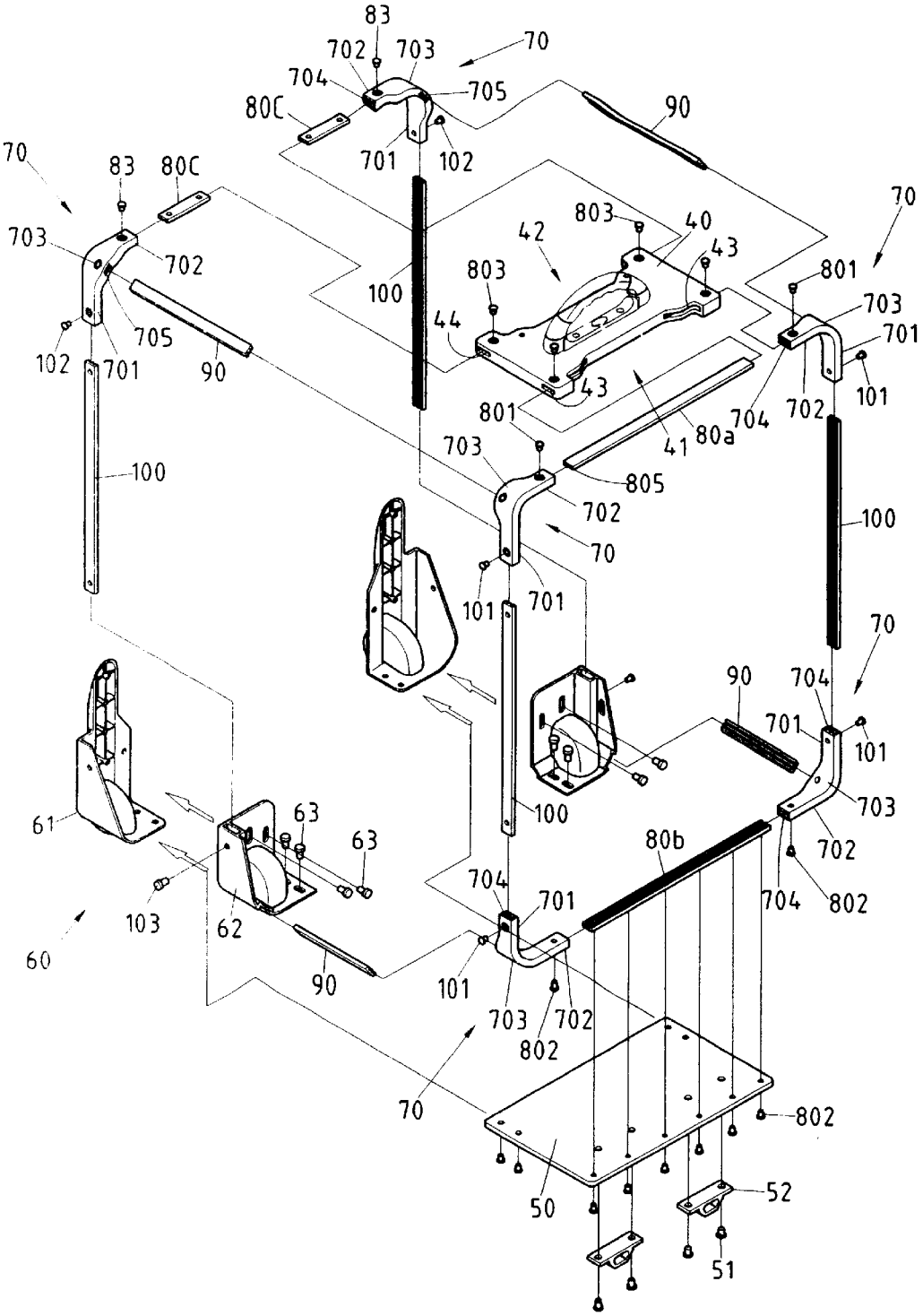
FIG. 3 shows an exploded view of the luggage framework of the present invention.
Figure 4:
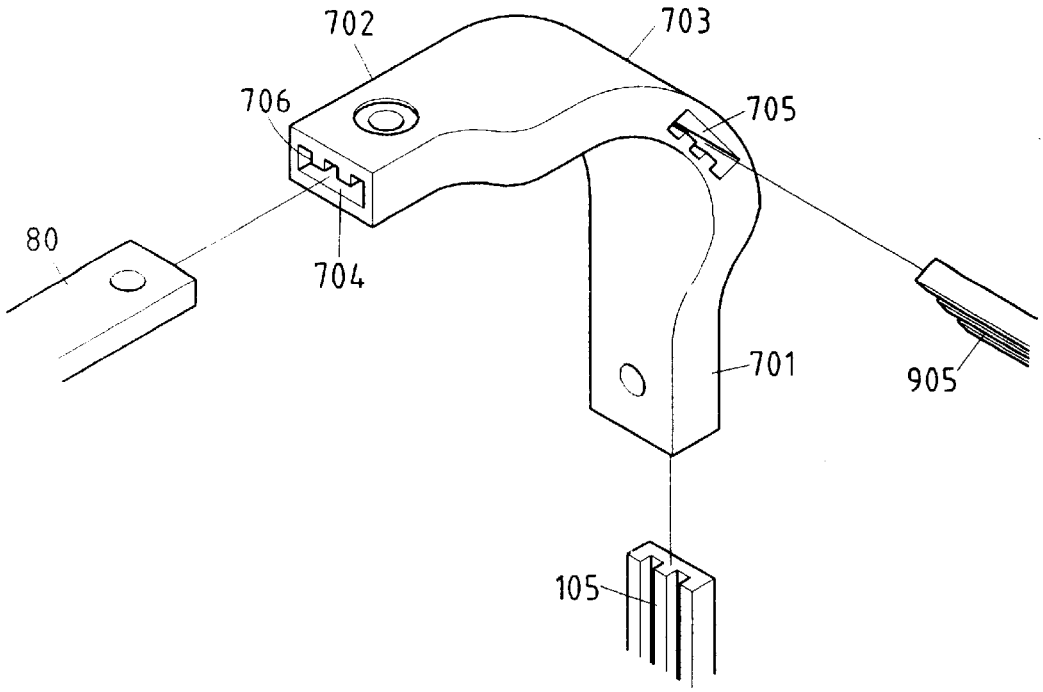
FIG. 4 shows a partial exploded view of the luggage framework of the present invention.

As shown in FIG. 2, the luggage framework of the present invention has several advantages, which are described explicitly hereinafter.

The luggage framework 20 of the present invention is formed of the corner connection seats 70, the long cross rods 80*a* and 80*b*, the short cross rods 90, the longitudinal support rods 100, a top plate 40, a bottom plate 50, and two wheel mounts 60. The luggage framework 20 is light in weight.

The luggage framework 20 of the present invention is strong in construction in view of the fact that the long cross rods 80, the short cross rods 90, and the longitudinal support rods 100 are made of a reinforced carbon fiber material.

The luggage framework 20 of the present invention is capable of accommodating a relatively greater number of articles.

Figure 7:
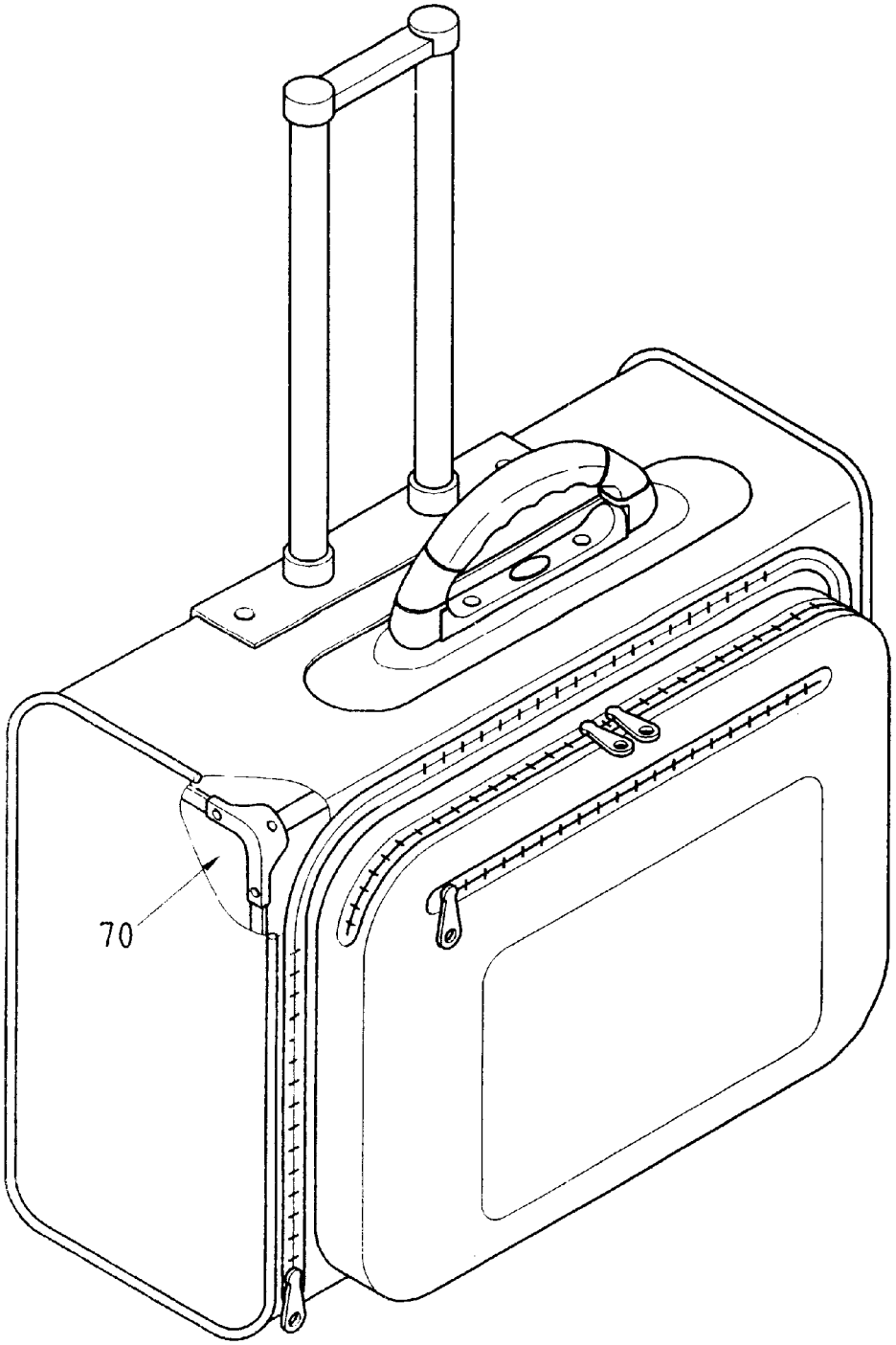
FIG. 7 shows a schematic view of a luggage framework comprising a plurality of modified corner connection seats of the present invention.
Figure 8:
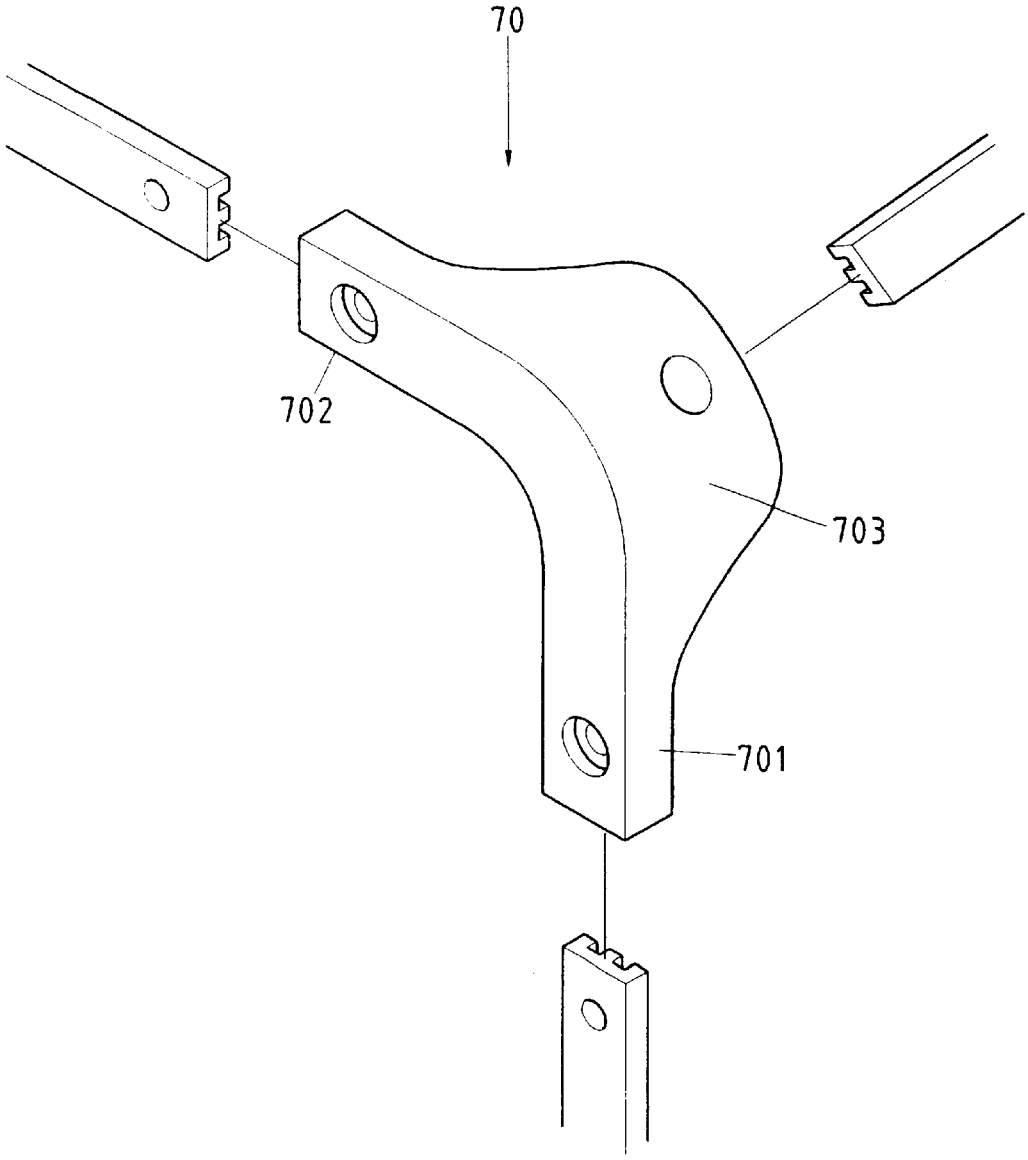
FIG. 8 shows a perspective view of the modified corner connection seat of the present invention.

As shown in FIGS. 7 and 8, the corner connection seats 70 of the present invention are modified in such a manner that they are formed of two arms 701 and 702, and a head 703, which are made integrally. Such a modification makes the luggage framework 20 of the present invention versatile.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

I claim:

1. A luggage framework comprising:

a top plate having a first recess on a front side thereof and a second recess on a back side thereof, said top plate having a through hole forward therein at respective ends of said front side, said top plate having a through hole formed therein at respective ends of said back side;

a pull-rod support frame having an upper locating plate, said second recess of said top plate being fastened to said upper locating plate, said pull-rod support frame having a bottom end;

a bottom plate having two leg seats on an underside thereof, said two leg seats fastened to said bottom plate by a plurality of rivets, said bottom plate being fastened to said bottom end of said pull-rod support frame;

two wheel mounts each comprised of a wheel and a wheel cover, said two wheel mounts respectively fastened to ends of a back side of said bottom plate, said wheel and said wheel cover being fastened by a plurality of rivets;

a plurality of corner connection seats each comprised of a first and a second arm and a head, said head positioned between said first and second arms, each of said first arm and said second arm and said head having an insertion hole;

a first long cross rod of a plurality of long cross rods being fastened at opposite ends thereof respectively to two of said corner connection seats, said two of said corner connection seats being affixed to respective opposite ends of a front side of said bottom plate, one end of said first long cross rod being inserted into an insertion hole of a second arm of one of said corner connection seats, an opposite end of said first long cross rod being inserted into an insertion hole of a second arm of another of said corner connection seats, said first long cross rod being fastened to said bottom plate by a plurality of rivets;

a plurality of short cross rods fastened to said back side of said top plate by a plurality of rivets, each of said plurality of short cross rods having an end inserted into an insertion hole of a respective corner connection seat;

a plurality of corner cross rods in which two of said plurality of corner cross rods are fastened respectively at ends thereof into an insertion hole of a respective head of said corner connection seats fastened to said top plate, another two corner cross rods of said plurality of corner cross rods being fastened respectively at an end thereof into an insertion hole of a respective head of said corner connection seats fastened to said bottom plate, an opposite end of each of said another two corner cross rods being inserted into a respective said wheel cover; and a plurality of longitudinal support rods in which two of said longitudinal support rods are fastened by a rivet at a respective end thereof to said first arm of one of said plurality of corner connection seats, another two of said longitudinal support rods being fastened by a rivet at a respective top end thereof to said first arm of another of said plurality of corner connection seats and at a respective bottom end thereof to a respective said wheel cover.

2. The luggage framework of claim 1, wherein each of said insertion holes of said plurality of corner connection seats has a corrugated surface, each of said long cross rods and said short cross rods and said corner cross rods and said longitudinal support rods having a corrugated surface matingly engageable with said corrugated surface of said insertion holes of said plurality of corner connection seats.

* * * * *